United States Patent [19]

Gwyn

[11] 4,397,422

[45] Aug. 9, 1983

[54] FULL SPECTRUM SELECTIVE COLOR PRODUCING AND SPRAYING DEVICE

[76] Inventor: Marion V. Gwyn, 8035 Coolidge, Center Line, Macomb, Mich. 48015

[21] Appl. No.: 270,329

[22] Filed: Jun. 4, 1981

[51] Int. Cl.[3] ..... A62C 13/60

[52] U.S. Cl. ..... 239/307; 239/318; 222/136

[58] Field of Search ..... 239/142, 304, 307, 305, 239/302, 310, 318; 222/136, 135

[56] References Cited

U.S. PATENT DOCUMENTS

| | | | |
|---|---|---|---|
| 3,282,227 | 11/1966 | Nielsen | 239/318 X |
| 3,622,126 | 6/1969 | Eberle | 239/142 X |
| 4,163,523 | 8/1979 | Vincent | 239/305 |

*Primary Examiner*—John J. Love
*Assistant Examiner*—Gene A. Church
*Attorney, Agent, or Firm*—Peter A. Taucher; John E. McRae; Robert P. Gibson

[57] ABSTRACT

Apparatus for mixing and spraying colorants, such as paints or dyes. The apparatus comprises means for directing pressurized air through a venturi. Individual tubes or lines extend from individual colorant containers to the throat of the venturi, whereby the fast-moving air entrains the colorants into the air stream; the air colorant mixture is fed through a spray gun and onto the work to be colored. Metering valves in the individual colorant lines control the relative amounts of specific colorants admitted to the venturi throat, and hence the final color of the mixture discharged from the gun onto the work.

5 Claims, 3 Drawing Figures

FULL SPECTRUM SELECTIVE COLOR PRODUCING AND SPRAYING DEVICE

GOVERNMENT INTEREST

Figure 1:
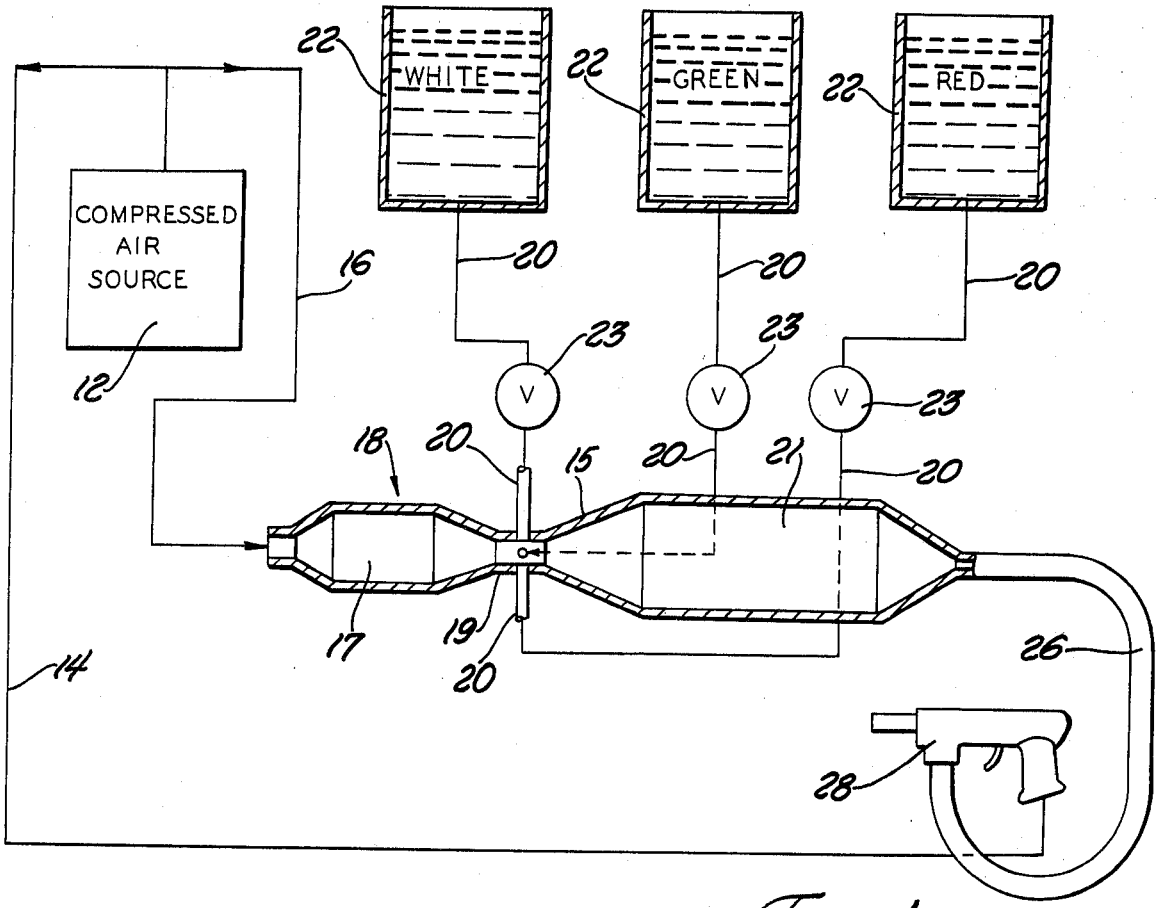

The invention described herein may be manufactured, used, and licensed by or for the Government for governmental purposes without payment to me of any royalty thereon.

BACKGROUND AND SUMMARY OF THE INVENTION

This invention relates to an apparatus for mixing and spraying different colorants, i.e., paints, dyes and stains, to achieve various color combinations on a target workpiece. The invention is particulary applicable to application of camouflage paints on military vehicles, especially near the battlefront when it is desired to change the vehicle to match the color of the terrain or background scene.

This invention utilizes a pressurized air source to supply relatively constant pressure air to a venturi mixer system. Colorants are drawn into the venturi throat for thorough mixing and subsequent introduction to a spray nozzle. The throat of the venturi may be equipped with a relatively large number of suction ports equidistantly spaced around the throat circumference; e.g., eight suction ports. Each port is connected to a pipe or conduit that leads from a separate colorant supply vessel or container; a metering valve in each conduit regulates or varies the flow rate through the respective conduit. As pressurized air flows through the venturi throat, colorants are drawn through those ports that communicate with opened metering valves. The different colorants are intermixed with the pressurized air and each other in the venturi throat. By selective adjustment of the various metering valves, it is possible to produce a large range of colors, shades and hues from a relatively small number of primary colors.

Preferably, the colorant-mixing action is completed in an elongated cylindrical chamber connected to the exit end of the venturi throat. Rotating propellers or agitators within the chamber cooperate with fixed baffles on the chamber walls to achieve a complete colorant mixing action. The elongated chamber supplies the mixed colorant to a conventional spray gun.

In its preferred form, the invention includes additional features, such as colorant solvent distribution system for preventing clog-up of the system passages by partially dried colorant. Another advantageous feature involves a standby power means for operating the agitators in the cylindrical mixing chamber when there is no pressurized air flowing through the venturi. Use of the standby power source keeps the mixed colorants in a thoroughly mixed condition during short intervals between successive spray applications of the mixed colorant onto the work or target.

In order to achieve reproducible colors on the work with minimum trial-and-error experimentation, I contemplate that the controls for the individual metering valves will be correlated to provide a specific shade or hue from specific percentages of the pertinent primary colors, e.g., 3 parts white, 27 parts blue and 7 parts red. The individual metering valves can be individually adjusted in accordance with a color chart having the percentages of pertinent primary colors thereon. Alternately the individual metering valves can be interconnected at a master controller that can be set to automatically adjust the individual valves in accordance with a selected target color shown on the controller dial or on a separate color chart. If the metering valves are electrically operated, the valve flow rates can be selected by use of rheostats in the electrical valve control system. Direct manual setting of each valve is also possible.

THE DRAWINGS

FIG. 1 schematically illustrates the principal features of a rudimentary mixing-spraying system embodying my invention.

Figure 2:
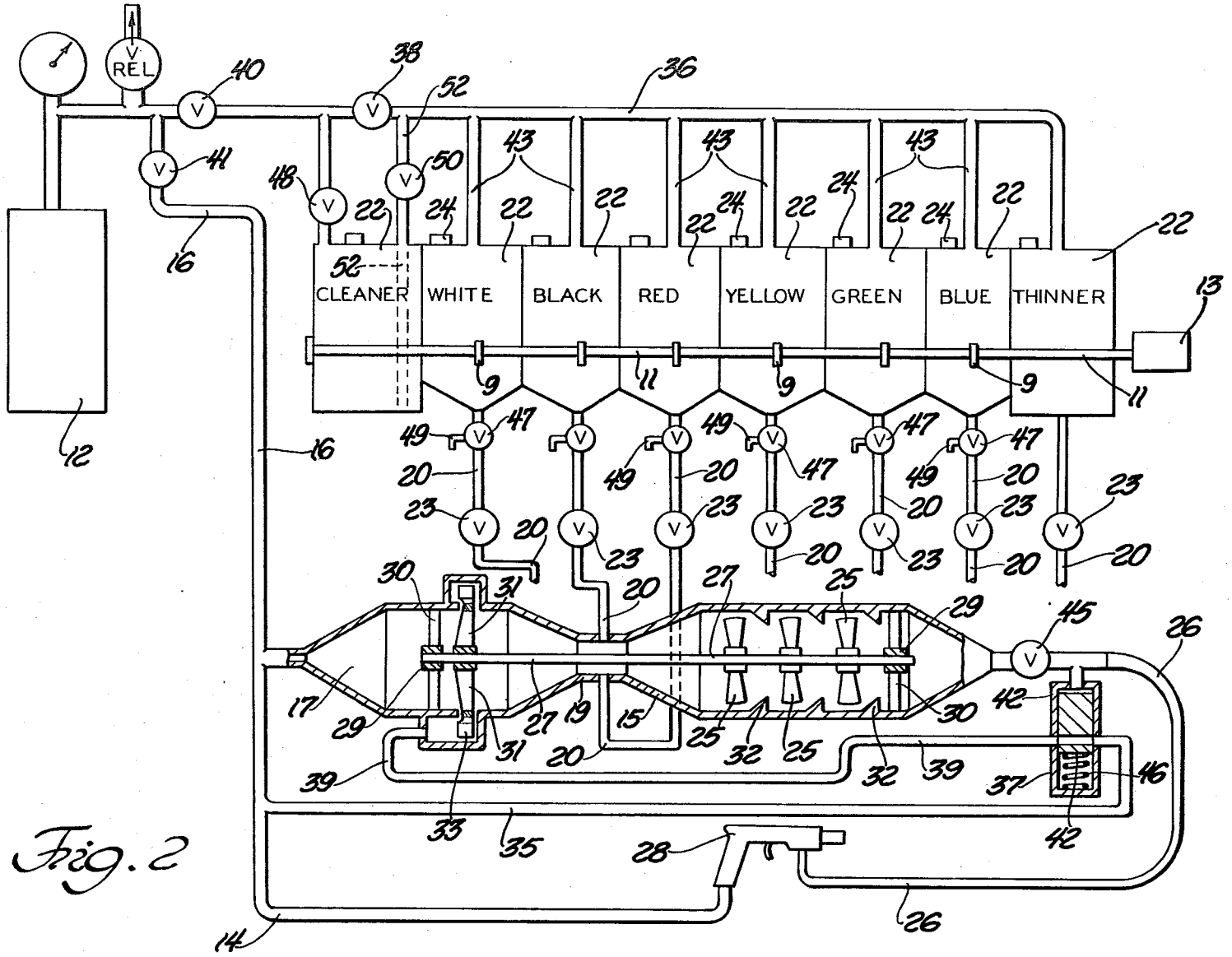

FIG. 2 is a schematic representation of an embodiment of my invention incorporating refinements not shown in FIG. 1.

Figure 3:
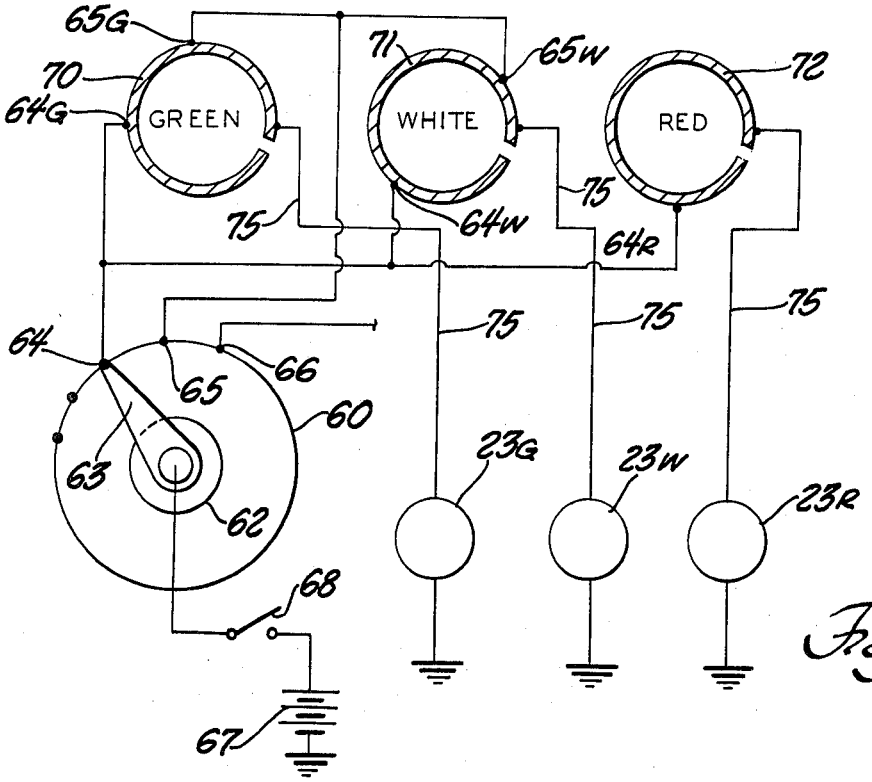

FIG. 3 schematically illustrates an electrical control circuit useful for controlling certain valves used in the FIG. 1 mixing-spraying system.

Referring to FIG. 1, there is shown a colorant mixing and spraying device 10, comprising a pressurized air supply source 12 having two air flow lines 14 and 16 leading, respectively, to a spray gun 28, and venturi mixer 18. The mixer includes a relatively large diameter inlet chamber 17, a narrow throat 19, a divergent transition duct 15, and an outlet chamber 21. While air is flowing through chamber 17, it has a relatively high pressure and a relatively low linear flow rate. As the air flows through throat 19 its pressure decreases but its velocity greatly increases. The wall that defines venturi throat 19 connects with three separate tubes or liquid lines 20 leading from separate containers 22 for colorant, such as paint or dye. Each flow line 20 is perpendicular to the venturi throat axis at its point of connection with the venturi wall, whereby colorants from all of the containers 22 can flow into the venturi by the suction force created by the high velocity low pressure air flowing through venturi throat 19. An adjustable metering valve 23 in each line 20 controls or adjusts the flow rate in each line, to thus achieve different colors or hues in the final colorant mixture, dependent on the setting of each valve 23. Colorants are mixed together in venturi throat 19. As the air-colorant mixture flows through transition duct 15, it experiences a velocity change that generates turbulence for effecting an additional mixing action on the colorants. Mixed colorant flows from chamber 21 through hose 26 to a spray gun 28 at a pressure which is high enough to vaporize the paint. Additional air can be supplied through line 14 to the spray gun to assist in paint vaporization.

FIG. 2 shows a refined version of the FIG. 1 system that includes a number of openable shut-off valves designated by reference numerals 38, 40, 41, 45, 48 and 50. Compressed air from source 12 flows across valve 41 through line 16 to inlet chamber 17 of the venturi mixer. When valves 40 and 38 are opened, air pressure is also applied through branch lines 43 to colorant containers 22, thus pressurizing the spaces above the liquid colorants. Each container is initially charged with liquid colorant through an opening that is closed by a cap 24. Metering valves 23 allow pressurized colorant to flow through individual lines 20 to the venturi throat 19. The operation is similar to that previously described except for the fact that each colorant is pressurized to promote flow toward the venturi. The system may include a container 22 for paint thinner. Depending on the viscosity of the colorant, the metering valve 23 may be opened to introduce thinner into the mixture produced by the venturi mixer.

FIG. 2 shows the colorant containers 22 as liquid vessels arranged to have the liquids poured therein through openings closed by caps 24. If desired, the liquid in each vessel can be physically isolated from the pressurized air supplied through lines 43 by floating pistons or bellows devices resting on the upper liquid surfaces. A further method of isolating the colorant from the pressurizing air is to store the liquids in prepackaged, flexible envelopes sized to the interior dimensions of containers 22; air pressure applied through lines 43 ruptures each envelope, permitting flow through lines 20.

To avoid pigment separation of the colorants in containers 22, each container may be agitated or vibrated by a powered system that comprises a motor 13 having a shaft 11 and cam-type knocker elements 9 thereon. Motor operation causes shaft 11 to rotate cams 9, which slightly shift the associated containers in a direction 22 normal to the plane of the paper; a spring, not shown, may be associated with each container to return the container to its normal position. The amplitude of the motion is relatively small. As a further refinement, the FIG. 2 system includes means for agitating the fluidized colorant mixture while it is in venturi chamber 21. The agitating means comprises a series of propeller blades 25 carried on a rotary shaft 27 supported in bearings 29 that are suspended within the venturi mixer by radial struts 30. When air is flowing through inlet chamber 17, the flowing air acts on turbine blades 31 carried by shaft 27. Blades 31 cause rotation of shaft 27 and the associated propellers 25. The rotating propellers throw colorant particles toward annular baffles 32. Each baffle defines a throat downstream from one of the propellers, such that the fluidized mixer discharged from each propeller is required to accelerate and change direction as it flows through the throat defined by the associated baffle; the mixture decelerates after passing each baffle. Mixing action is enhanced.

The mixed colorant is fed through hose 26 to spray gun 28. A pressurized stream of air is fed through line 14 to the gun to promote flow of colorant from the gun to the work. During nonspray periods the flow through hose 26 may be stopped by a shut-off valve 45. All flow through venturi chambers 17 and 21 is then interrupted. To maintain the colorant in chamber 21 in a mixed condition during the nonspray periods, I provide a set of auxiliary turbine blades 33. Pressurized air is supplied to the auxiliary turbine blades through a passage system that includes branch passage 35, valve 37, and passage 39. Valve 37 includes a flow control piston element 42. When the aforementioned valve 45 is closed, the pressure above element 42 drops, thus allowing a spring 46 to move element 42 upwardly to a position opening passage 39 to passage 35. When valve 45 is in an open condition, the pressure above element 42 increases to move element 42 downwardly to a position closing passage 39. Valve 37 may in practice be a conventional servo-operated valve.

After each period of use it is desired that the system be cleaned of colorant, especially the small passages and ports associated with valves 23 and lines 20. Each colorant container 22 may be individually drained by operating a three-way valve 47 to a condition wherein the container communicates with a liquid discharge spigot 49. After each valve 47 is returned to a position for closing spigot 49, two other valves 48 and 50 are opened; valve 38 is closed. Compressed air flows from source 12 across valves 40 and 48 to the space above the liquid cleaner in the first container 22. Pressurization of the space above the cleaner in the first container 22 causes cleaner to be pumped upwardly through line 52 into line 36 and thence downwardly through branch lines 43 into the colorant containers 22. The fastmoving air flowing from venturi chamber 17 through throat 19 draws cleaner from each colorant container 22 downwardly through each line 20 and metering valve 23, thus removing colorant particles from the various ports and internal surfaces. The air-liquid mixture is exhausted through spray gun 28.

The aforementioned metering valves 23 may be manually-operated valves having graduations associated with the operating knob to indicate the flow for any given knob setting. Color charts can be devised to indicate the individual knob settings for any given output color, shade or hue.

The aforementioned metering valves 23 can be electrically-operated valves operated by small torque motors to different liquid flow rates in accordance with the magnitude of the electrical signal supplied to the individual motor. The signal to each motor may be adjusted by means of a manual rheostat. If desired, the electrical rheostats for the individual valve motors may be controlled by a single knob, as schematically shown in FIG. 3. The FIG. 3 controller includes a stationary drum or disk 60 that mounts a rotary manual knob 62 having an electrical slider 63 arranged to engage individual terminals 64, 65, 66, etc., on the drum or disk periphery. Each terminal corresponds to a specific output color, shade or hue. A color chart can be used to indicate the color for each terminal; alternately the colors themselves can be printed at the various terminals. The drawing shows three terminals, but in practice additional terminals would be provided.

Electrical power from source 67 is applied through an on-off switch 68 to slider 63, thence to the particular terminal 64 or 65 or 66 etc. Terminal 64 is shown connected to stationary resistances 70, 71 and 72 at taps 64G, 64W, and 64R, respectively. Terminal 65 is connected to resistances 70 and 71 at taps 65G and 65W. The magnitude of the resistance offered by the respective resistance 70, 71, 72, etc., is determined by the location of the operative tap 64G, 65W, etc., i.e., the length of resistance in the circuit. The number of resistances 70, 71, 72, etc., corresponds to the number of primary colorants in the system; FIG. 1 uses three colorants, wherein FIG. 2 uses six. Each resistance is connected to one of the metering valve motors 23G, 23W, 23R, etc., by an electrical signal supply line 75. It will be seen that manual adjustment of slider 63 automatically adjusts the electrical signals supplied to the individual motors 23G, 23W, 23R, etc., to thus achieve individual colorant flow rates that will produce the color, shade or hue corresponding to the slider 63 position. The color can be changed quickly, as necessary to achieve a particular color combination on the work.

As previously noted, the system was designed particularly for use in applying camouflage colorants to military vehicles. In such an operation, various shades of greens, browns, etc., may be sequentially sprayed onto different areas of the vehicle to achieve a desired irregular pattern. The invention is advantageous in that colorants are mixed as they are used, thus avoiding losses that could occur if colorants were mixed separately and then not used. The system also avoids the time expenditure that would be involved in a separate mixing operation, since there is no need to transfer mixed colorant from one container to another. The quickness with which the color can be changed also tends to reduce the total time expenditure. A further advantageous feature of the illustrated system is the large number of colors, shades and hues obtainable. The venturi system shown in FIG. 2 enables six primary colors to be simultaneously mixed together in varying proportions. Since the mixing and spraying occur simultaneously, only a relatively low time expenditure is required to perform the entire operation. A relatively small number of different colorants are required to be maintained in inventory.

I wish it to be understood that I do not desire to be limited to the exact details of construction shown and described for obvious modifications will occur to a person skilled in the art.

I claim:

1. A colorant mixing and spraying apparatus comprising plural means for separately storing different colorants, a venturi mixer comprising a large diameter inlet chamber, a central convergent-divergent throat connected to the inlet chamber, and an enlarged outlet chamber connected to said throat; a colorant flow line (20) extending from each colorant storage means to the venturi throat so that each flow line has its discharge opening in the venturi throat surface; an independently adjustable metering valve (23) in each colorant flow line; means for supplying high pressure air to the inlet chamber of the venturi mixer so that pressurized air flows through the venturi throat to entrain colorant from each flow line into the air stream; and a spray device (28) operatively connected to the enlarged outlet chamber.

2. The colorant mixing and spraying apparatus of claim 1 and further comprising passage means connected with the high pressure air supply means for pressurizing the colorant in each storage means to promote flow of colorant through the respective flow line toward the venturi throat.

3. The colorant mixing and spraying apparatus of claim 1 and further comprising rotary agitator means in the outlet chamber of the venturi mixer, air-operated turbine means in the inlet chamber of the venturi mixer, and a shaft connection between the turbine and rotary agitator means.

4. The colorant mixing and spraying apparatus of claim 3; the rotary agitator means comprising a number of rotary agitator propellers spaced along the length of the outlet chamber; and throat-defining baffle means immediately downstream from each propeller for generating turbulence in the air-colorant mixture.

5. The colorant mixing and spraying apparatus of claim 1 and further comprising means for storing liquid colorant cleaner, and valved fluid connections (48, 50, 52) enabling the high pressure supply air to pump cleaner solution through each colorant storage means and associated colorant flow line (20) into the throat of the venturi mixer.

* * * * *